United States Patent [19]

Polley

[11] 4,223,612

[45] Sep. 23, 1980

[54] LIFTING DEVICE FOR RAILWAY TANK CAR

[76] Inventor: Richard B. Polley, 20 Trappers Way, St. Charles, Mo. 63301

[21] Appl. No.: 3,180

[22] Filed: Jan. 15, 1979

[51] Int. Cl.[3] ..... B61D 49/00; B61F 5/50; B66C 1/20

[52] U.S. Cl. ..... 105/1 R; 294/74; 414/348; 105/358; 105/362

[58] Field of Search ..... 105/1 R, 358, 359, 360, 105/361, 362; 414/342, 347, 348; 294/74, 815 F, 67 DB, 67 EA

[56] References Cited

U.S. PATENT DOCUMENTS

| | | | |
|---|---|---|---|
| 1,437,968 | 12/1922 | Fitch | 414/342 |
| 1,466,296 | 8/1923 | Fitch | 414/342 |
| 3,752,083 | 8/1973 | Bitterberg | 105/1 A |

FOREIGN PATENT DOCUMENTS

| | | | |
|---|---|---|---|
| 1242131 | 8/1960 | France | 294/67 DB |
| 362741 | 12/1931 | United Kingdom | 294/67 EA |

*Primary Examiner*—Richard A. Bertsch

[57] ABSTRACT

In accordance with the present invention, a lifting pocket is provided in a tank car bolster bottom cover plate or other tank car support plate. The support plate includes an opening for receiving a U-shaped lifting hook having a first leg having an eye for attachment to a chain or cable and an outer leg having a tapered end portion. The opening is in communication with a pocket formed above the opening for receiving the lifting hook. The pocket includes walls extending upwardly from the plate and a cover plate closing the top of the pocket. The pocket is spaced from the outer end of the support plate sufficient for the outer leg of the hook to extend into the pocket transversely of the car and the inner leg to a vertical surface at the side of the car. The support or bolster is sufficiently wide that the hook cannot be inserted into the pocket other than transversely of the car with the first leg engaging the side of the car and the outer leg extending into the pocket. The side walls and cover plate prevent insertion of the hook into the pocket except with the hook extending transversely of the car with the inner leg engaging the side of the car and the outer leg extending straight upward into the pocket.

6 Claims, 7 Drawing Figures

LIFTING DEVICE FOR RAILWAY TANK CAR

BACKGROUND OF THE INVENTION

This invention relates to lifting devices for railway tank cars.

AAR Mechanical Division Circular D. V. 1897 specifies that new cars ordered after July 1, 1978 be provided with connecting lugs or rings four places on the car. The rings or lugs are to be utilized to lift the car when it is essentially upright and is within 15° of the vertical, and each ring or lug should be able to support 40 percent of the gross weight of a loaded car. It has been proposed to increase the angle up to 45° of the vertical. It is contemplated that the rings or lugs will be located at opposite ends of the car below the tank on either side of the body bolster adjacent the side sill.

However, the presence of such rings or lugs presents a serious potential problem for misuse. Wreck clearance crews may improperly rely on lifting lugs to drag or lift overturned cars. Possible consequences of such misuse are damage to the bolster and/or the tank. For example, the lifting force may tear the body bolster from the tank body and/or cause a crack in the tank body which would cause lading to spew out, causing damage to persons or property.

It, therefore, would be desirable to provide a lifting lug assembly or arrangement in which the lifting hook cannot be attached to the ring or opening in a lug unless the direction of lift is within 45° of the vertical axis of the tank.

SUMMARY OF THE INVENTION

The object of the present invention is to provide a lifting lug assembly in which it is not possible to apply load through the cable and lifting hook into the lifting lug assembly unless the direction of lift is confined to within a specified angle relative to the vertical axis of the tank.

In accordance with the present invention, a lifting pocket is provided in a tank car bolster bottom cover plate or other tank car support plate. The support plate includes an opening for receiving a U-shaped lifting hook having a first leg having an eye for attachment to a chain or cable, and an outer leg having a tapered end portion. The opening is in communication with a pocket formed above the opening. The pocket includes walls extending upwardly from the plate and a cover plate closing the top of the pocket. The pocket is spaced inwardly from the end of the bolster sufficient for the outer leg of the hook to extend into the pocket transversely of the car and the inner leg or eye portion to engage a vertical surface at the side of the car. The support plate is sufficiently wide extending longitudinally of the car that the hook cannot be inserted into the pocket other than transversely of the car with the first leg engaging the side of the car and the outer leg extending into the pocket.

Longitudinally spaced supports or gussets extend from the pocket to a vertical tank car support located at the side of the car, and are welded to the bolster or transverse support. The side walls and cover plate prevent insertion of the hook into the pocket other than with the hook extending transversely of the car with the first leg engaging the side of the car and the outer leg extending into the pocket. A hook stop is preferably welded to a side support of the car which further ensures that the hook is not inclined longitudinally more than 45° from the vertical axis of the tank, and which tends to maintain the hook vertical as the car is lifted vertically with the hooks in engaged position.

THE DRAWINGS

DESCRIPTION OF PREFERRED EMBODIMENTS

Figure 1:
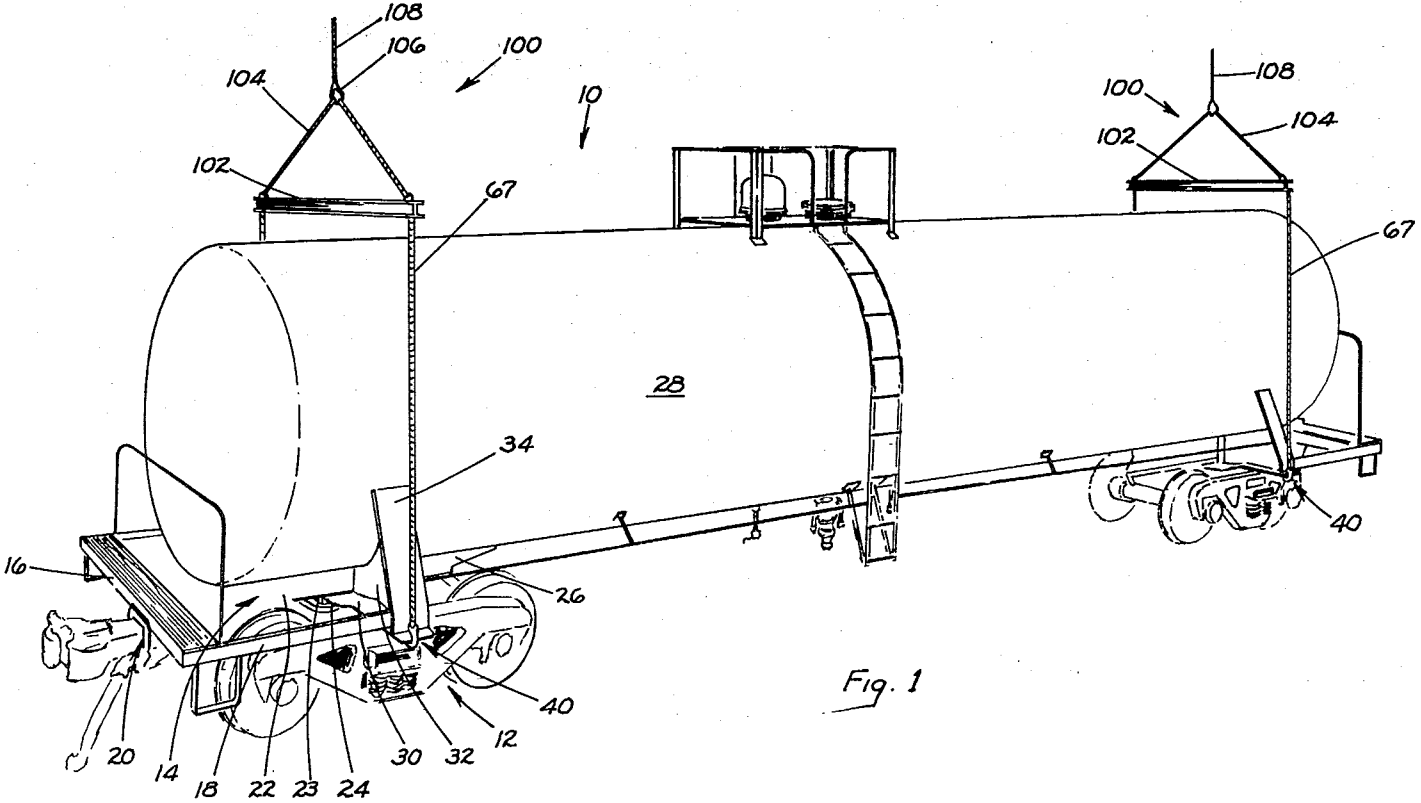
FIG. 1 is a schematic perspective view illustrating the lifting lug assembly of the present invention used to lift a tank car in a direction within 45° of the vertical axis of the tank.

A railway tank car is indicated in the drawings generally at 10. The tank car includes trucks 12 at opposite ends of the car which support a tank car underframe indicated at 14. The underframe includes an end sill 16, transversely spaced side sills 18 and a stub sill 20. A center filler 22 is located in the stub sill and supports a center plate 23 which engages a center plate bowl 24 in the truck. Extensions 26 of the stub sill support the tank body 28 inboard of the center filler.

A bolster bottom cover plate 30 extends transversely of the tank car. A vertical bolster web 32 is welded to the cover plate 30 and supports the tank 28. A bolster end cover plate 34 is welded to cover plate 30 and to vertical bolster web 32.

Figure 2:
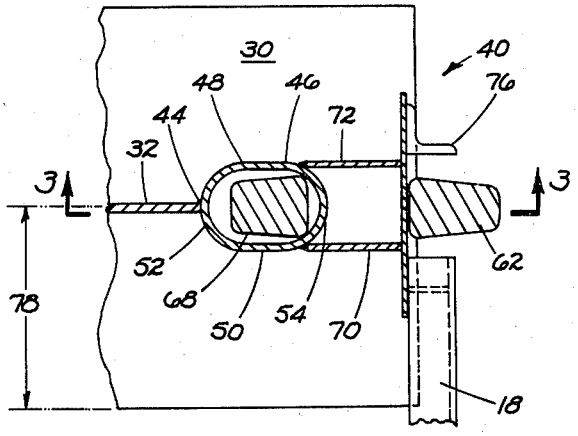
FIG. 2 is a detail plan view of the lifting pocket assembly of the present invention.
Figure 3:
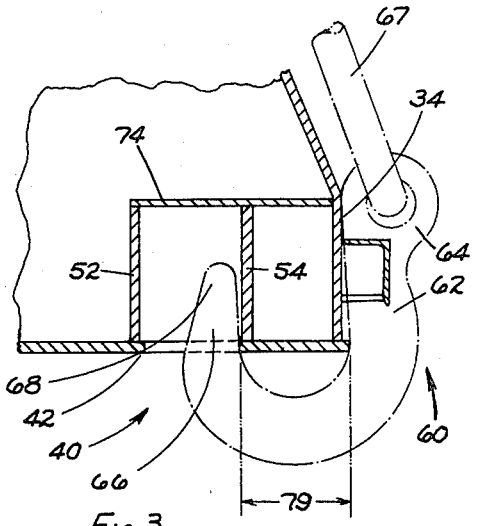
FIG. 3 is a side elevation view looking in the direction of the arrows along the line 3—3 in FIG. 2.

The lifting lug assembly of the present invention is indicated generally at 40 and, as shown in FIGS. 2 and 3, includes an opening 42 in cover plate 30. It is to be noted that vertical web 32 is foreshortened as indicated at 44 to accomodate the pocket assembly of the present invention. A portion of tubing or piping 46 is welded to plate 30 around the periphery of opening 42. Tubing 46 includes side walls 48 and 50, and end walls 52 and 54. The size of the opening 42 and the dimensions of tubing 46 is such that a hook indicated generally at 60 having a first leg 62, and eye 64 and an outer leg 66 having a tapered end portion or nose 68 can readily be inserted into the pocket. Longitudinally spaced reinforcing gussets 70 and 72 extend from the pipe 46 to a bolster end cover plate 34. A closure plate 74 extends over tubing 46 and also over the space defined between reinforcing gussets 70 and 72. An angle 76 is welded to the end cover plate 34 to aid, with the side sill 18, in maintaining hook 60 in proper vertical position for lifting.

It is first to be noted that the longitudinal extent of the bolster cover plate 30 in the vicinity of the pocket 40 is such that the hook 60 cannot be inserted into the pocket 40 longitudinally of the car. In other words, the transverse extent 78 in FIG. 2 is greater than the distance 79 between the legs 62 and 66 in FIG. 3.

Figure 4:
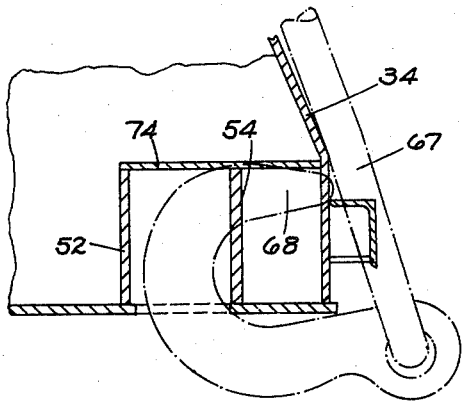
FIG. 4 is a side elvation view similar to FIG. 3 illustrating the need for enclosing walls in the pocket of the present invention.

The closed side and end walls 48, 50, 52 and 54 aid in preventing attachment of the hook to move the tank horizontally. In particular, the inner wall 54 prevents the nose portion 68 of the hook from assuming an engaged position when an effort is made to pull the tank horizontally, transversely of the tank, as illustrated in FIG. 4. Walls 48, 50 and 52 function similarly to prevent engagement of the hook for pulling the tank horizontally from any direction on the horizontal plane.

Figure 5:
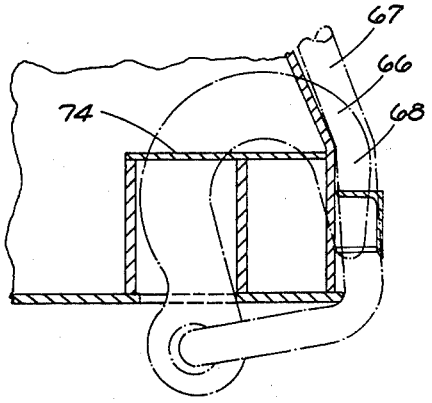
FIG. 5 is a side view similar to FIG. 3 illustrating the need for a top cover plate in the pocket of the present invention.

The cover 74 also prevents the hook from being extended into the pocket 40 and looping the hook end portion 68 over one of the side walls to form an engaged position with the pocket, as shown in FIG. 5.

The inner surfaces of the pocket 48, 50, 52 and 54 aid in achieving engagement with the leg 66 into the pocket into the position shown in FIG. 3 wherein the hook extends transversely of the car and the leg 62 engages a bolster end cover 34.

It is to be noted that the side sill 18 and the lug or stop 76 tend to maintain the hook 60 vertical as shown in FIG. 3.

There are four such pockets 40 located at each corner of a railway tank car. Two such pockets are located on either side of the support plate 30, on each end of the car, as shown in FIG. 1.

Figure 6:
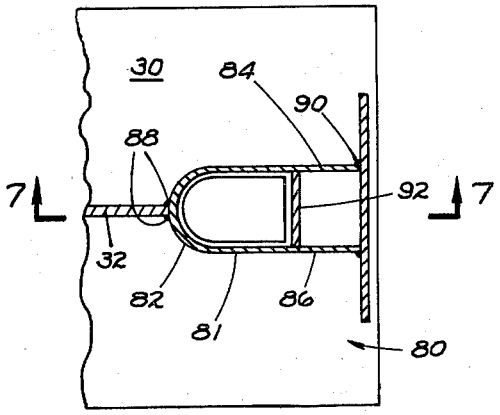
FIG. 6 is a plan view similar to FIG. 2 illustrating a modification.
Figure 7:
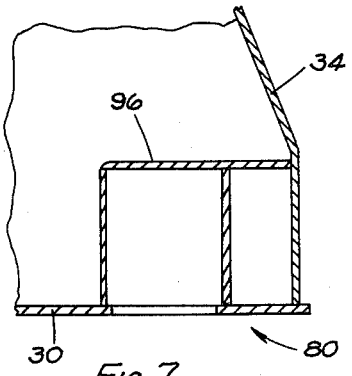
FIG. 7 is a side elevation view looking in the direction of the arrows along the line 7—7 in FIG. 6.

A modification of the present invention is shown in FIGS. 6 and 7. In this embodiment, a pocket 80 includes a formed plate indicated at 81 including a curved inner end portion 82 and a pair of legs longitudinally spaced as indicated at 84 and 86. This formed plate 81 is welded to the support plate 30, the vertical bolster web 32 as indicated at 88, and is welded to bolster end cover plate 34 as indicated at 90. It is seen that the formed plate 80 takes the place of three members of tube 46 and gussets 70 and 72 in FIG. 2. A longitudinally extending support plate 92 is provided which extends between legs 84 and 86 over bolster plate 30 and is welded thereto. A cover plate 96 similar to cover 74 is also provided.

A chain or cable 67 is attached to openings 65 in eye 64 to lift the tank car as shown in FIGS. 1 and 3.

It will be apparent, however, that due to the configuration of the pocket 40 of the present invention, it is very difficult to insert the hooks 60 into the pocket except when the hooks are extending transversely of the car with the legs 62 engaging the bolster end cover plates 34 and the inner legs located in pocket 40 or 80 as the case may be, as shown in FIG. 3. Thus the pocket assembly of the present invention provides for safe use of the lifting hooks contemplated for lifting a tank car in a direction within up to 45° of the vertical axis of the tank.

It is to be noted that the provision of the pocket assembly of the present invention on a support plate, has the added benefit of eliminating supports extending longitudinally of the car normally required to support a jacking pad.

FIG. 1 shows lifting assembly 100 for lifting a tank car with the pocket assembly of the present invention. The assembly includes a transverse beam 102 to which cables 67 are attached at either end. Another cable 104 is attached to opposite ends of beam 102. Cable 104 extends through an eye 106 to which is attached a lifting cable 108. Cable 108 is attached to a lifting crane (not shown).

What is claimed is:

1. A lifting pocket assembly for a railway tank car in which it is difficult to attach a lifting hook unless the direction of lift of the car is within about 45° of the vertical axis of the tank comprising:

a lifting pocket provided in a railway tank car support plate extending transversely of the car and supporting a tank adapted for the transport of lading; said support plate including an opening for receiving a U-shaped lifting hook including a first leg having an eye for attachment to a chain or cable, and an outer leg adapted to extend into the opening, said opening being in communication with a pocket formed above the opening for receiving the lifting hook; said pocket including walls extending upwardly from the plate, and a cover closing the top of the pocket; said pocket being spaced from the outer end of the support sufficient that the outer leg of the hook extends into the pocket transversely of the car, and the inner leg engages a vertical surface at the side of the car, whereby said side walls and cover plate prevent engagement of the hook in the pocket except with the hook extending transversely of the car with the inner leg engaging the side of the car and the outer leg extending into the pocket within 45° of the vertical axis of the tank.

2. A lifting pocket assembly according to claim 1 in which the support is sufficiently wide that the hook cannot be inserted into the pocket other than transversely of the car with the first leg engaging the side of the car and the outer leg extending into the pocket.

3. A lifting pocket assembly according to claim 1 including longitudinally spaced supports or gussets extending from the pocket to a vertical tank car support located at the side of the car.

4. A lifting pocket assembly according to claim 1 including a hook stop attached to the side support of the car which tends to prevent the hook from being inserted with more than a specified inclination to the vertical axis of the tank and which tends to maintain the hook vertical as the car is lifted with the hooks in engaged position.

5. A lifting pocket assembly according to claim 3 wherein said gussets, side walls and front wall are combined into a single piece.

6. A railway tank car comprising:

trucks located at opposite ends of the car, each truck supporting a tank car underframe, each tank car underframe supporting at least an end portion of a tank adapted for the transport of lading; each said underframe including a transverse tank support plate located generally above a respective one of said trucks and extending transversely of the car toward the side of the car; each of said tank supports including a lifting pocket near each outer end of said transverse support; said pocket including an opening for receiving a leg of a U-shaped lifting hook including a first leg having means for attachment to a chain or cable and an outer leg adapted to extend into said opening, said opening being in communication with a pocket formed above the opening receiving the lifting hook; said pocket including walls extending upwardly from said support, and a cover closing the top of the pocket; said pocket being spaced from the outer end of the support sufficient that the outer leg of the hook extends into the pocket transversely of the car, and the inner leg engages a vertical surface at the side of the car, whereby said side walls and cover plate prevent engagement of the hook in the pocket except with the with the hook extending transversely of the car with the first leg engaging the side of the car and the outer leg extending into the pocket within 45° of the vertical axis of the tank.

* * * * *